US007635030B2

(12) United States Patent
Knight et al.

(10) Patent No.: US 7,635,030 B2
(45) **Date of Patent: *Dec. 22, 2009**

(54) INVERTED ELECTRICAL SUBMERSIBLE PUMP COMPLETION TO MAINTAIN FLUID SEGREGATION AND ENSURE MOTOR COOLING IN DUAL-STREAM WELL

(75) Inventors: Jeffrey W. Knight, Owasso, OK (US); Howard G. Thompson, Claremore, OK (US); Ernesto Alejandro Vilcinskas, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 172 days.

This patent is subject to a terminal disclaimer.

(21) Appl. No.: 11/839,948

(22) Filed: Aug. 16, 2007

(65) Prior Publication Data

US 2008/0093085 A1 Apr. 24, 2008

Related U.S. Application Data

(63) Continuation-in-part of application No. 11/583,692, filed on Oct. 19, 2006, now Pat. No. 7,487,838.

(51) Int. Cl.
*E21B 43/00* (2006.01)

(52) U.S. Cl. ..... 166/369; 166/306; 166/106

(58) Field of Classification Search ..... 166/369, 166/306, 106

See application file for complete search history.

(56) References Cited

U.S. PATENT DOCUMENTS 2,196,462 A 4/1940 Hollander
3,716,309 A 2/1973 Mitchell
5,659,214 A 8/1997 Guardiani et al.
5,845,709 A 12/1998 Mack et al.
5,979,599 A * 11/1999 Noles ..... 182/36
6,394,183 B1 5/2002 Schrenkel et al.
6,547,003 B1 * 4/2003 Bangash et al. ..... 166/106
6,666,269 B1 12/2003 Bangash et al.
6,698,521 B2 3/2004 Schrenkel et al.
7,487,838 B2 * 2/2009 Knight et al. ..... 166/369
2003/0145989 A1 8/2003 Shaw et al.

* cited by examiner

*Primary Examiner*—William P Neuder
(74) *Attorney, Agent, or Firm*—Fellers, Snider, Blankenship, Bailey & Tippens

(57) ABSTRACT

An electrical submersible pump (ESP) completion installed in casing perforated for water disposal and production. A packer separates the disposal zone and the production zone. An inverted ESP assembly is located inside of a canister. The ESP and canister are lowered on a tubing string into the casing. The canister has a downwardly extending canister extension flow-directing member that communicates with water in the casing and which passes through the disposal zone. Water is pumped down the canister extension member into the disposal zone and formation. Well fluids are drawn up the extension from the production zone. Various configurations are disclosed to facilitate flowing well fluids, e.g., oil-rich mixture or water passed the motor for cooling the motor of the inverted ESP while maintaining fluid segregation. The completion is particularly suited for production wells wherein the oil and water have a strong tendency to naturally segregate within the wellbore.

11 Claims, 5 Drawing Sheets

INVERTED ELECTRICAL SUBMERSIBLE PUMP COMPLETION TO MAINTAIN FLUID SEGREGATION AND ENSURE MOTOR COOLING IN DUAL-STREAM WELL

CROSS REFERENCE TO RELATED APPLICATIONS

This application claims the benefit of co-pending U.S. patent application Ser. No. 11/583,692, filed Oct. 19, 2006, entitled "Inverted Electrical Submersible Pump Completion to Maintain Fluid Segregation and Ensure Motor Cooling in Dual Stream Well," which application is incorporated herein by reference.

FIELD OF THE INVENTION

This invention relates generally to an electrical submersible pump (ESP) completion that maintains fluid segregation and ensures motor cooling in a dual stream well, i.e., in a well that exhibits a considerable degree of natural oil/water fluid segregation within the wellbore. More particularly, the invention relates to an inverted ESP deployed within a canister, wherein produced well fluids are directed passed the motor for cooling, an oil-rich production mixture is delivered to the surface and produced and water is re-injected in-situ into a separate injection zone.

BACKGROUND OF THE INVENTION

Fluid in many producing oil and/or gas wells is elevated to the surface of the ground by the action of a pumping unit or a pumping apparatus installed in the lower portion of the well bore, such as an electrical submersible pump (ESP). The electric motor used in such systems typically generates considerable heat. To keep the motor from overheating, the motor is typically cooled by transferring heat to surrounding annular fluids. In many cases, the pumping unit is set in the well casing above perforations located in the well's producing zone. By placing the pumping unit above the perforations, the unit can make use of the fluid flowing passed the motor to cool the motor. Insufficient fluid velocity, however, will cause the motor to overheat and may lead to early motor failure.

To increase efficiency, it may be desirable to inject produced water into an injection formation and to deliver partially de-watered or oil-rich fluids to the surface. One ESP configuration that facilitates injecting water into the formation involves inverting the ESP. However, an inverted ESP configuration does not inherently allow for a flow of fluids passed the motor when the ESP is located above well perforations.

Therefore, it is desirable to facilitate cooling of an ESP motor in an inverted ESP configuration when the ESP is located above well perforations. It is further desirable to produce oil-rich fluids while re-injecting produced water into an injection zone.

SUMMARY OF THE INVENTION

An electrical submersible pump (ESP) system is disclosed that utilizes a commonly available ESP canister or pod to encase an inverted ESP. A pack-off element is set in the canister to separate a water stream below the pack-off and an oil-rich mixture above the pack-off. The pack-off element is provided to ensure that the water stream will enter an intake of the pump while the oil-rich stream is directed to a tubing string for flow to the surface.

In one embodiment, the water is injected into the formation by the inverted pump while the oil-rich stream entering the canister flows passed the motor, thereby cooling the motor with flow through an annular space inside the canister. The oil-rich stream then enters the production tubing above the inverted ESP via a perforated tubing joint within the pod, where the oil-rich stream flows to the surface either via natural flow or via artificial lift means.

A second embodiment involves the use of an inverted pump and a recirculation pump that are both located within a canister or pod. The recirculation pump circulates a portion of the produced water stream over the motor. One or more recirculation tubes may be employed to direct the water to a location proximate the motor of the ESP. A second portion of the water stream is injected back into the disposal zone. This embodiment is advantageous because it eliminates the necessity for a pack-off element within the canister and also because the embodiment utilizes water for cooling the motor flow rather than the oil-rich mixture. Water has better heat transfer characteristics than the oil-rich mixture. In this embodiment, the oil-rich mixture flows to the surface through a perforated joint that is run outside and above the pod/canister.

Another embodiment utilizes an inverted shroud within the canister/pod to force the water stream to flow passed the motor prior to entering the pump intake. An advantage to this design is that it is simple and has few ancillary equipment requirements.

An additional embodiment utilizes a canister within a canister to direct water passed the motor for cooling the motor.

A further embodiment utilizes an inverted shroud to direct an oil rich mixture passed the motor to cool the motor. A canister directs a water stream from the well to the pump, which injects the water back into the formation.

DESCRIPTION OF THE PREFERRED EMBODIMENTS

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 1:
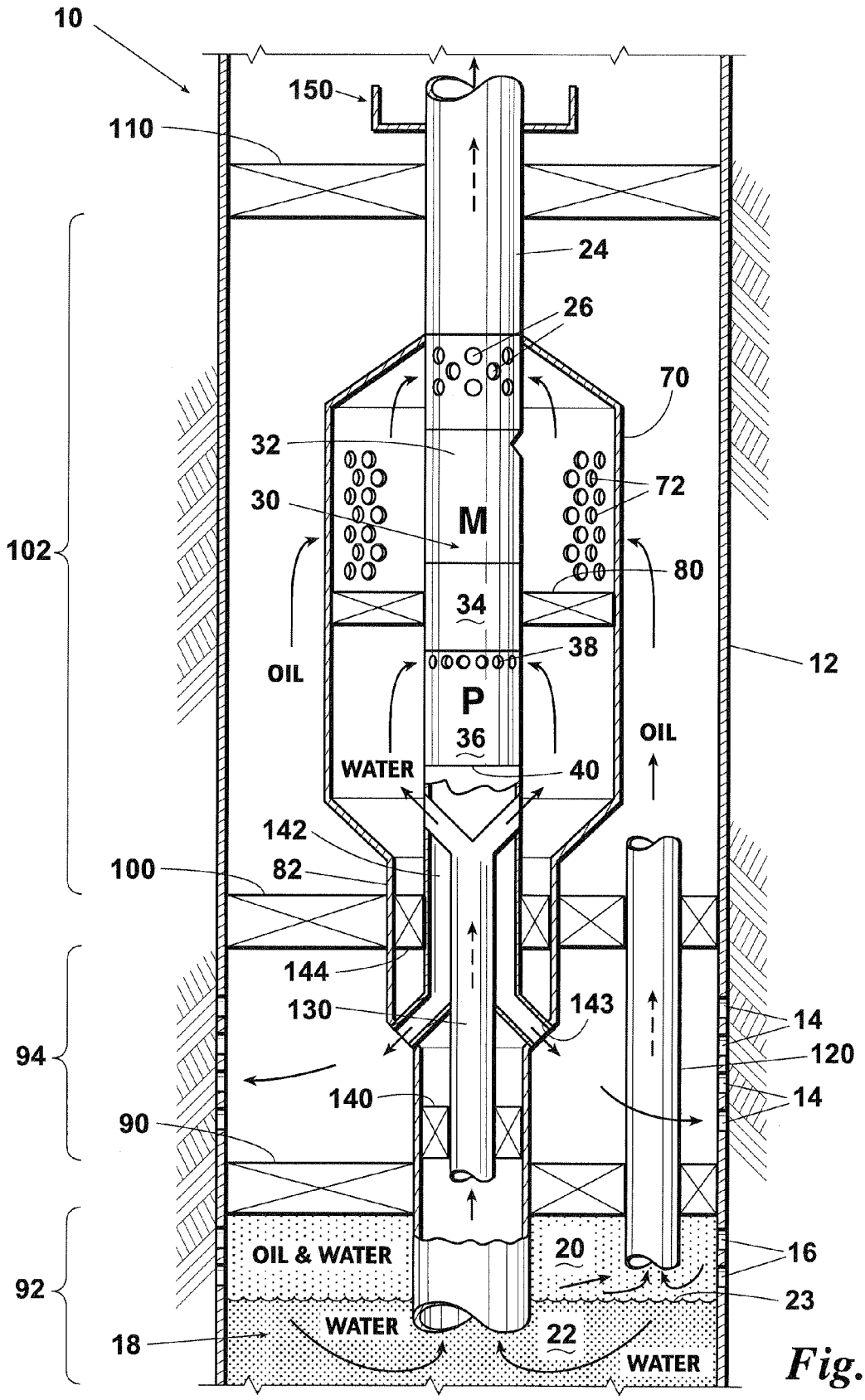
FIG. 1 is a partial cut-away view of a first embodiment of an inverted ESP completion of the invention set in a well.

Referring now to FIGS. 1-5, shown are various embodiments of the inverted ESP completion of the invention for maintaining fluid segregation and to ensure motor cooling in a dual stream well. Well 10 has a well casing 12 that extends into the earth. Well casing 12 defines disposal perforations 14 (FIG. 1) and production perforations 16 (FIG. 1). Well fluids 18 (FIG. 1) migrate through production perforation 16 and accumulate in well casing 12. Well fluids 18 comprise an oil-rich mixture 20 and water 22. An oil/water interface 23 is defined there between. Tubing 24 runs from the surface and extends into well casing 12. Tubing 24 defines perforated tubing joint 26.

Submersible pumping unit 30 is suspended on tubing 24 below perforated tubing joint 26. Submersible pumping unit 30 is a submersible pumping unit having a motor 32 above a seal section 34, which is above a pump 36. In some embodiments (FIGS. 1 and 3-5), pump 36 defines pump intake 38 and pump outlet 40.

It should be noted that like elements are assigned the same numerical designation in each figure. Further, it should be understood that although submersible pumping unit 30 is shown along with perforations 14, 16 and associated packing only in FIG. 1, submersible pumping units 30 in the embodiments of FIGS. 2-5 are similarly deployed within casing 12.

In another embodiment (FIG. 2) submersible pumping unit 30 is suspended on tubing 24 below perforated tubing joint 26. Submersible pumping unit 30 includes a submersible pumping unit having a motor 32 above a seal section 34, which is above a recirculation pump 42, which is located above a main pump 36. Recirculation pump 42 defines a recirculation pump intake 44 that feeds recirculation pump 42 and main pump 36. Main pump 36 defines pump outlet 40. Recirculation pump 42 preferably produces a greater volume of fluid than main pump 36.

Figure 2:
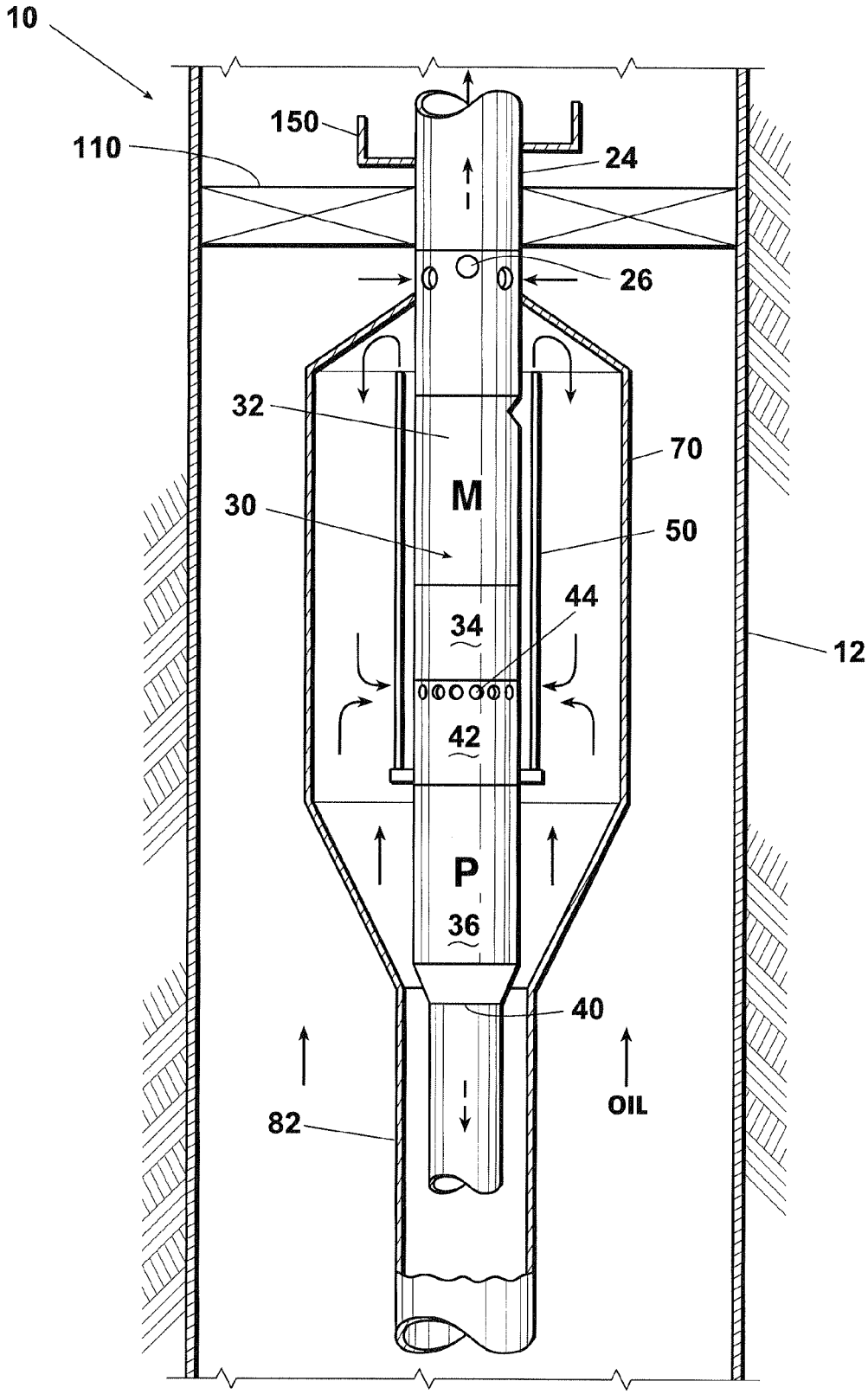
FIG. 2 is a partial cut-away view of a second embodiment of an inverted ESP completion of the invention.

In the embodiment of FIG. 2, recirculation tubing 50 is provided in communication with recirculation pump 42 for receiving output from recirculation pump 42 and for delivering a portion of fluid produced by recirculation pump 42 to a location adjacent to or above motor 32.

Variations of the embodiment of FIG. 2 are also possible. For example, main pump 36 and recirculation pump 42 may each have their own intake ports. Alternatively, recirculation pump 42 may be eliminated entirely and recirculation tubing 50 may tap into main pump 36 to deliver a portion of fluid produced by main pump 36 to a location adjacent to or above motor 32. The various configurations are generally an inverted adaptation of the embodiments described in U.S. Pat. No. 5,845,709, which is incorporated herein by reference.

In another embodiment (FIG. 3), a shroud 60 is provided for surrounding motor 32, seal section 34 and pump intake 38 of submersible pumping unit 30. Shroud 60 has an open upper end to allow fluid to enter shroud 60 for directing fluid passed motor 32 and into pump intake 38.

Figure 4:
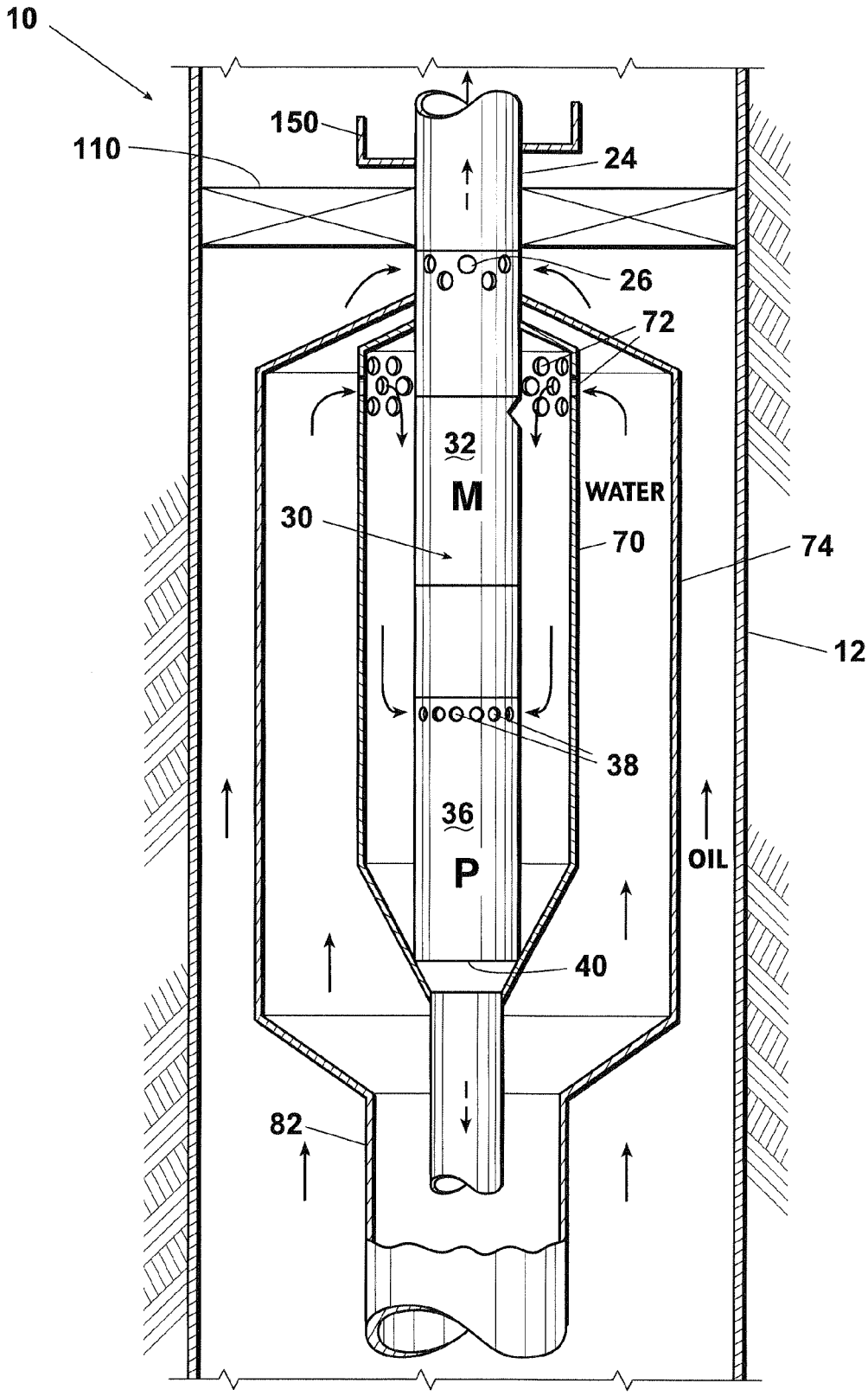
FIG. 4 is a partial cut-away view of a fourth embodiment of an inverted ESP completion of the invention.

In the embodiment of FIG. 1, canister 70 surrounds submersible pumping unit 30 and perforated tubing joint 26. Canister 70 defines canister perforations 72 above pump intake 38. In the embodiment of FIG. 4, a secondary exterior canister 74 surrounds canister 70. Secondary exterior canister 74 preferably does not enclose perforated tubing joint 26.

Figure 3:
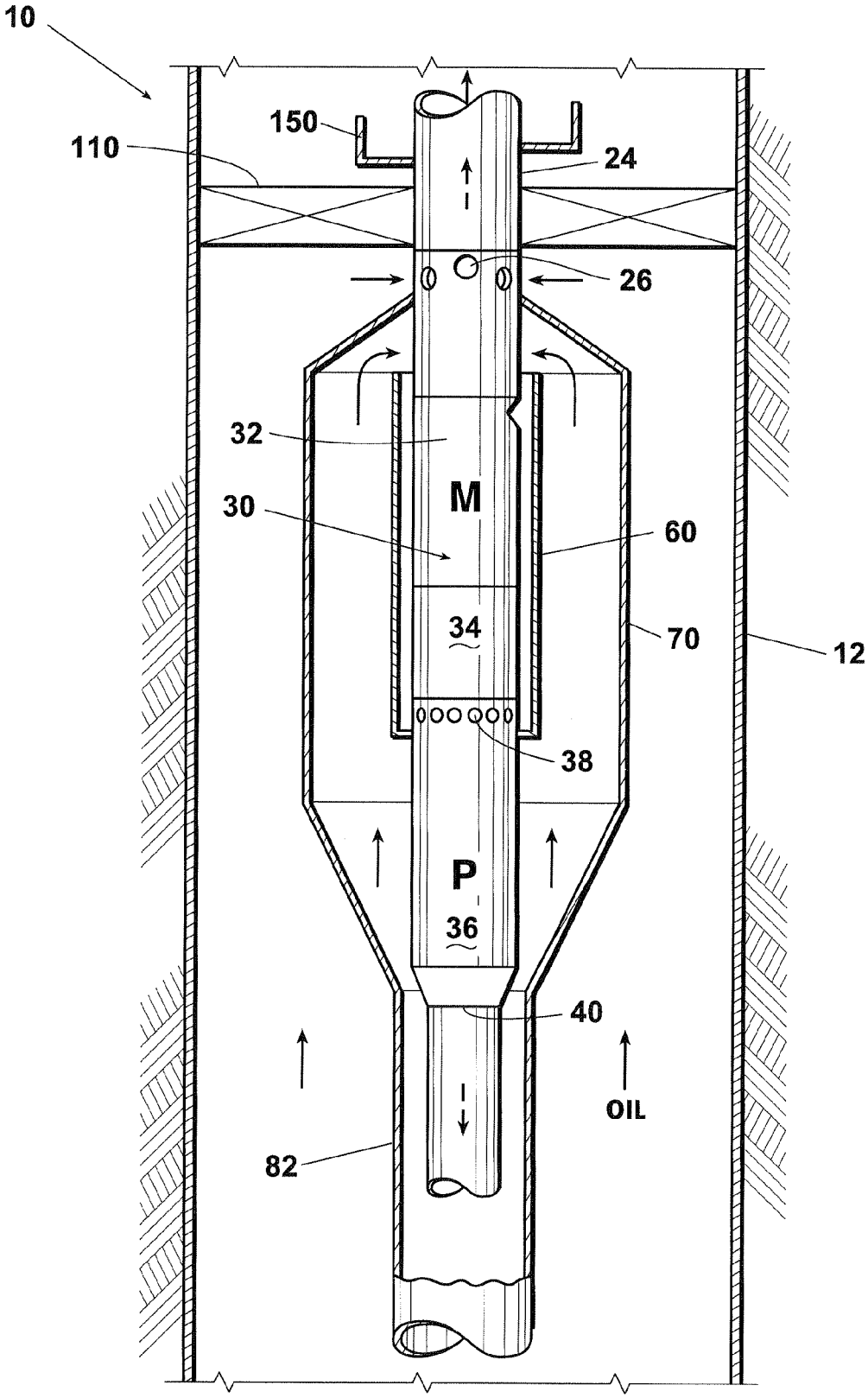
FIG. 3 is a partial cut-away view of a third embodiment of an inverted ESP completion of the invention.

In the embodiments of FIGS. 2 and 3, canister 70 surrounds the submersible pumping unit but preferably does not enclose perforated tubing joint 26.

In the embodiment of FIG. 1, an upper interior packer or pack-off element 80 is provided. Upper interior packer 80 has an inside surface that engages submersible pumping unit 30 between motor 32 and pump 36. Upper interior packer 80 also has an outside surface that engages canister 70 below canister perforation 72.

Canister 70 further defines a downwardly extending canister extension flow-directing member 82 that extends into fluids 18 (FIG. 1) below the oil/water interface for allowing uptake of water and delivery of water to pump intake 38 (FIGS. 1, 3, 5) or recirculation pump intake 44 (FIG. 2).

A lower packer 90 (FIG. 1) is set in well casing 12 above production perforation 16 of well casing 12. Lower packer 90 has an outside surface in contact with well casing 12 and has an inside surface in contact with canister extension flow-directing member 82. Lower packer 90 defines an upper limit of production zone 92 and lower limit of disposal zone 94. Disposal zone 94 is preferably a separate zone from that of production zone 92. Although the invention is discussed primarily in the context of an injection zone located below a production zone, it should be understood that the invention may also be deployed in an environment wherein an injection zone is located above a production zone.

A central packer 100 is set in well casing 12 above disposal perforations 14 of well casing 12. Central packer 100 has an outside surface in contact with well casing 12 and has an inside surface in contact with canister extension flow-directing member 82. Central packer 100 defines an upper limit of disposal zone 94 and a lower limit of pumping zone 102. In one embodiment, an upper packer 110 is set in well casing 12 above submersible pumping unit 30. Upper packer 110 has an outside surface in contact with well casing 12 and has an inside surface in contact with tubing 24. Packer 110 is desirable in instances where gas lift is utilized as a means of artificial lift. If gas lift is not required to lift the oil-rich mixture, then upper packer 110 is not strictly necessary. An oil transfer tube 120 (FIG. 1) passes through central packer 100 and lower packer 90 for allowing oil to flow from production zone 92 to pumping zone 102.

In the embodiment of FIG. 1, an interior water intake passageway 130 is provided inside of canister extension flow-directing member 82 for communicating production zone 92 with an interior of canister 70 for passing water from production zone 92 to an inside canister 70 for subsequent intake by pump intake 38.

In the embodiment of FIG. 2, interior water intake passageway 130 (shown in FIG. 1) is located inside of canister extension flow-directing member 82 for communicating production zone 92 with an interior of canister 70 for passing water from production zone 92 to an inside of canister 70 for subsequent intake by recirculation pump intake 44.

In the embodiment of FIG. 4, canister extension flow-directing member 82 communicates with production zone 92 with an interior of secondary exterior canister 74 for passing water from production zone 92 to an inside of secondary exterior canister 74. Water inside of secondary exterior canister 74 passes through canister perforations 72 for subsequent flow passed motor 32 and into pump intake 38.

Referring now to FIG. 1, in one embodiment, a lower interior packer 140 is located in a canister extension flow-directing member 82 and has an outside surface in contact with canister extension flow-directing member 82 and an inside surface in contact with interior water intake passageway 130. Lower interior packer 140 defines an upper limit of production zone 92 within canister extension flow-directing member 82 and a lower limit of disposal zone 94 in canister extension flow-directing member 82. Lower interior packer 140 may not be required in all installations. An interior water output annulus 142 communicates pump outlet 40 with disposal zone 94 exterior to canister extension member 82. Water is introduced into disposal zone 94 through extension outlets 143. Interior water output annulus 142 is defined by interior water intake passageway 130 and canister extension flow-directing member 82.

Still referring to FIG. 1, in one embodiment, a central interior packer 144 is provided inside of canister extension flow-directing member 82. Central interior packer 144 has an outside surface in contact with canister extension flow-directing member 82 and has an inside surface in contact with interior water output annulus 142. Central interior packer 144 defines an upper limit of disposal zone 94 within canister extension flow-directing member 82 and defines a lower limit of pumping unit 102 in canister extension flow-directing member 82. Central interior packer 144 may not be required in all installations.

Gas lift valves 150 (FIGS. 1-5) are provided above upper packer 110 for selectively introducing high pressure gas into tubing string 24 to assist in bringing oil-rich mixture 20 to the surface. In wells that do not require additional artificial lift, gas lift valves 150 will not be required.

Figure 5:
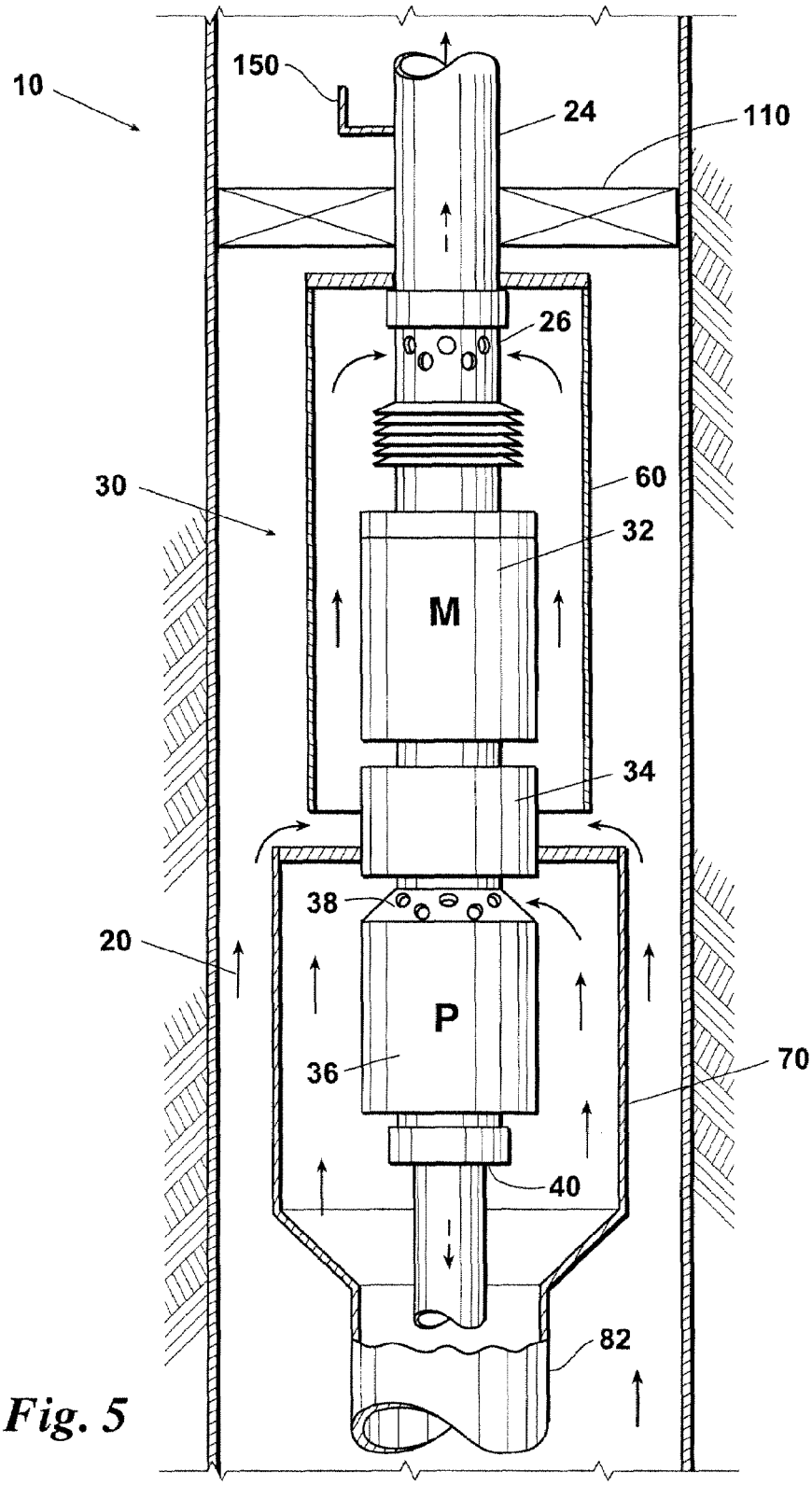
FIG. 5 is a partial cut-away view of a fifth embodiment of an inverted ESP completion of the invention.

Referring now to FIG. 5, shown is an electrical submersible pump (ESP) system that utilizes an ESP canister 70 or pod to encase part of an inverted submersible pumping unit 30. The encased part of submersible pumping unit 30 includes pump 36 and pump intake 38. Canister 70 directs the water stream from the well to pump 36 to be injected. Seal section 34 and motor 32 remain outside of canister 70 and above canister 70. The oil-rich fluid stream flows around canister 70 and up to production tubing string 24 via perforated tubing joint 26 set above canister 70. The oil-rich fluids then flow to the surface either via natural flow or via gas lift facilitated by gas lift mandrels 150 or by other artificial lift means. To ensure proper cooling of motor 32, motor 32 and seal section 34 are surrounded by shroud 60, which ensures that the oil-rich flow stays close to motor 32 and increases the velocity of the flow carrying away heat generated by motor 32. Shroud 60 is hung from a tubing collar 61 immediately above perforated tubing joint 26, by means of an adequately constructed shroud hanger.

In use, submersible pumping unit 30 and canister 70 is lowered on tubing 24 into well casing 12 to a location above or proximate to disposal perforations 14 and production perforations 16. Tubing 24 defines perforated tubing joint 26. Pumping unit 30 is suspended on tubing 24 below perforated tubing joint 26. Fluids 18 in well casing 12 migrate into well casing 16 through production perforations 16. Under certain conditions fluids 18 tend to separate into an oil-rich layer 20 and a water layer 22. The two layers 20, 22 define an oil/water interface 23.

In each embodiment, and as shown in FIG. 1, lower packer 90 is set in casing 12 above production perforations 16 of well casing 12. Lower packer 90 has an outside surface in contact with well casing 12 and an inside surface in contact with canister extension flow-directing member 82. Lower packer 90 defines an upper limit of production zone 92 and a lower limit of disposal zone 90.

Central packer 100 is set in casing 12 above disposal perforations 14 of well casing 12. Central packer 100 has an outside surface in contact with well casing 12 and an inside surface in contact with canister extension flow-directing member 82. Central packer 100 defines an upper limit of disposal zone 94 and a lower limit of pumping unit zone 102.

In one embodiment, upper packer 110 is set in casing 12 above said pumping unit 30. Upper packer 110 has an outside surface in contact with well casing 12 and has an inside surface in contact with tubing 24.

Oil transfer tube 120 passes through central packer 100 and lower packer 90 for allowing oil-rich mixture 20 to flow from production zone 92 to pumping unit zone 102. Oil-rich mixture 20 may then flow in an annulus defined by an outside of canister 70 (FIGS. 1-5) or an outside of secondary exterior canister 74 (FIG. 4) and an inside of well casing 12.

In the embodiment of FIG. 1, oil-rich mixture 20 flows through canister perforations 72, passed motor 32, and into perforated tubing joint 26, where oil-rich mixture 20 may then flow through tubing 24 to the surface. Oil-rich mixture 20 cools motor 32 as it flows passed motor 32. In other embodiments (FIGS. 2-5), oil-rich mixture 20 flows through oil transfer tube 120 (FIG. 1), into an annulus defined by an outside surface of canister 70 (FIGS. 2, 3, 5) or an outside surface of secondary exterior canister 74 (FIG. 4) and an inside surface of well casing 12. The oil-rich mixture 20 then passes directly into perforated tubing joint 26, where the oil-rich mixture 20 may then flow through tubing 24 to the surface under either natural flow or via artificial lift means.

In each embodiment, canister extension flow-directing member 82 extends downwardly and communicates with water 22. Water 22 passes into canister extension flow-directing member 82, inside of water intake passageway 130, and into canister 70.

In the embodiment of FIG. 1, water 22 passes through canister extension flow-directing member 82 and into canister 70 and is prevented from mixing with oil-rich mixture 20 by upper interior packer or pack-off element 80. Water 22 then flows from lower portion of canister 70 into pump intake 38 of pump 36. Pump 36 then directs water 22 out of pump outlet 40, down through canister extension flow-directing member 82 and out extension member outlets 143 into production zone 94, which is bound by central packer 100, lower packer 90 and well casing 12. Water 22 is then forced back into the underground formation through disposal perforations 14.

In the embodiment of FIG. 2, water 22 enters canister 70 and passes into pump intake 44 of recirculation pump 42. A first portion of water 22 is then injected into the disposal perforations 14, as discussed above with respect to FIG. 1. A second portion of water 22 is directed upwards through recirculation tubing 50, which forces water circulation within canister 70, thereby providing cooling to motor 32.

In the embodiment of FIG. 3, water 22 enters canister 70 and flows around an upper open end of shroud 60 and then downwardly passed motor 32 before entering pump intake 38 of pump 36. The flow of water 22 through the annulus defined by an outside of motor 32 and an inside of shroud 60 results in increased fluid flow velocity and improved cooling of motor 32. Water 22 is then pumped out of pump outlet 40 and injected into the underground formation through disposal perforations 14, as discussed above with respect to FIG. 1. Oil-rich mixture 20 flows upwardly outside of canister 70 and into tubing 24 through perforated tubing joint 26, where the oil-rich mixture 20 may then flow to the surface.

In the embodiment of FIG. 4, water passes into secondary exterior canister 74 before entering canister 70 through canister perforations 72. Water 22 then flows passed motor 32 before entering pump intake 38 of pump 36. The flow of water 22 through the annulus defined by an outside of motor 32 and an inside of canister 70 results in increased fluid flow velocity and improved cooling of motor 32. Water 22 then exits pump outlet 40 and is injected into the underground formation through disposal perforations 14, as discussed above with respect to FIG. 1. Oil-rich mixture 20 flows upwardly outside of secondary exterior canister 74 and into tubing 24 through perforated tubing joint 26 where oil-rich mixture 20 may flow to the surface via natural flow or artificial lift.

In the embodiment of FIG. 5, water passes into canister 70 before entering pump intake 38. Water 22 then exits pump outlet 40 and is injected into the underground formation through disposal perforations 14, as discussed above with respect to FIG. 1. Oil-rich mixture 20 flows upwardly outside canister 70 and into the open lower end of shroud 60. Flowing the oil-rich mixture 20 inside of shroud 60 results in increased fluid flow velocity and improved cooling of motor 32. The oil-rich mixture then enters tubing 24 through perforated tubing joint 26 where the oil-rich mixture 20 may flow to the surface via natural flow or artificial lift.

As discussed above, the invention allows an inverted submersible pumping unit 30 to be positioned above production perforations 16 in a manner that facilitates cooling of motor 32 with a flow of fluids directed adjacent motor 32, e.g., oil-rich mixture 20 inside of canister 70 (FIG. 1), recirculated water flow inside of canister 70 (FIGS. 2, 5), water flow inside of shroud 60 inside of canister 70 (FIG. 3), water flow inside of canister 70 inside of secondary exterior canister 74 (FIG. 4) or oil-rich mixture inside of shroud 60 (FIG. 5). In each of the embodiments, water is injected into the formation through disposal perforations 14 (shown in FIG. 1).

In each of the embodiments, oil-rich mixture 20 flows to the surface through tubing 24. Flow of oil-rich mixture 20 through tubing 24 may be selectively assisted with high pressure gas entering through gas lift valves 150 in a manner known in the art.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A well comprising:

casing defining disposal perforations and production perforations;

a packer for defining a disposal zone proximate said disposal perforations on a first side of said packer and for defining a production zone proximate said production perforation on a second side of said packer;

a tubing string received in said casing;

a submersible pumping assembly suspended on said tubing string, said submersible pumping assembly having a motor above a pump;

a canister surrounding said motor pump of said submersible pumping assembly, said canister having a downwardly extending canister extension flow-directing member for delivering water into said disposal zone;

an inverted shroud surrounding said motor, said shroud for intaking well fluids from said production zone and directing said production fluids past said motor for cooling said motor.

2. The well according to claim 1 further comprising:

an interior packer or pack-off element in said canister that divides said canister into a motor area and a pump area;

and wherein said canister defines canister perforations that communicate an annulus defined by an outside of said canister and an inside of said casing with said motor area for allowing oil to flow through said canister perforations for flowing said oil passed said motor to cool said motor.

3. The well according to claim 1 further comprising:

a recirculation pump for intaking water and for delivering a first portion of said water to said pump for delivery to said disposal zone and for delivering a second portion of said water to recirculation tubing for delivery of said second portion of said water upwards within said canister for circulating said water to cool said motor.

4. The well according to claim 3 wherein:

said recirculation tubing extends above said motor within said canister.

5. The well according to claim 1 wherein:

said shroud additionally surrounds a pump intake of said pump, said shroud having an open upper end and a closed lower end to direct water past said motor before delivery of said water to said pump intake.

6. The well according to claim 1 further comprising:

a secondary exterior canister surrounding said canister; and wherein said canister defines canister perforations on an upper end so that water flowing upwards in said secondary exterior canister flows into said canister perforations and down passed said motor and into intake ports of said pump.

7. A method of producing oil from a well comprising the steps of:

perforating casing at two locations to define a disposal perforation and production perforations;

installing a packer for defining a disposal zone proximate said disposal perforation on a first side of said packer and for defining a production zone proximate said production perforations on a second side of said packer;

lowering a submersible pumping assembly within said casing on a tubing string wherein said submersible pumping assembly has a motor above a pump, said submersible pumping assembly having a pump surrounded by a canister and a shroud surrounding a motor;

extending a downwardly extending canister extension flow-directing member of said canister through at least a portion of said disposal zone and at least a portion of said production zone.

8. The method according to claim 7 further comprising the steps of:

dividing said canister into a pumping zone and motor zone above said pumping zone, wherein said canister defines canister perforations in said motor zone;

drawing water up said canister extension member into said pump;

injecting water through said canister extension member into said disposal zone and back into a well formation;

delivering oil through said canister perforations, passed said motor and up said tubing string.

9. The method according to claim 7 further comprising the steps of:

providing a recirculation pump that receives water from said production zone and for delivering a first portion of said water to said pump for delivery of said water into said disposal zone and through said disposal perforations back into an underground formation, said recirculation pump delivering a second portion of said water upwards through recirculation tubing for circulating water within said canister, thereby providing cooling to said motor;

providing tubing perforations above said canister;

delivering oil through said tubing perforations, and up said tubing string.

10. The method according to claim 7 further comprising the steps of:

providing a shroud for surrounding said motor and a pump intake of said pump;

directing water into said canister, around said shroud, down passed said motor and into said pump intake for cooling said motor;

delivering said water from said pump to said disposal zone and through said disposal perforation back into an underground formation;

providing tubing perforations above said canister;

delivering oil through said tubing perforations, and up said tubing string.

11. The method according to claim 7 further comprising the steps of:

providing a secondary exterior canister around said canister;

providing canister perforations on an upper end of said canister;

directing water into said secondary exterior canister around an outside of said canister, through said canister perforations, passed said motor for cooling said motor and into a pump intake on said pump;

delivering water from said pump into said disposal zone and through said disposal perforations into a formation;

providing tubing perforations above said canister;

delivering oil through said tubing perforations, and up said tubing string.

* * * * *

UNITED STATES PATENT AND TRADEMARK OFFICE

CERTIFICATE OF CORRECTION

PATENT NO. : 7,635,030 B2
APPLICATION NO. : 11/839948
DATED : December 22, 2009
INVENTOR(S) : Knight et al.

It is certified that error appears in the above-identified patent and that said Letters Patent is hereby corrected as shown below:

Col. 7, Line 37, the word "motor" should be removed.

Signed and Sealed this

Sixteenth Day of February, 2010

David J. Kappos

David J. Kappos
*Director of the United States Patent and Trademark Office*